US005176109A

United States Patent [19]

Engstrom

[11] Patent Number: 5,176,109

[45] Date of Patent: Jan. 5, 1993

[54] PRESSURIZED BOILER PLANT

[75] Inventor: Folke Engstrom, Kotka, Finland

[73] Assignee: A. Ahlstrom Corporation, Karhula, Finland

[21] Appl. No.: 836,616

[22] Filed: Feb. 18, 1992

[30] Foreign Application Priority Data

Feb. 20, 1991 [FI] Finland ..... 910810

[51] Int. Cl.[5] ..... F22B 1/00

[52] U.S. Cl. ..... 122/4 D; 122/235.31; 122/331; 122/365

[58] Field of Search ..... 122/4 D, 235.31, 331, 122/365

[56] References Cited

U.S. PATENT DOCUMENTS 4,262,635 4/1981 Dauvergne et al. ..... 122/365 X
4,429,663 2/1984 Dorner et al. ..... 122/365
4,730,452 3/1988 Kallman ..... 122/4 D
4,756,257 7/1988 Vind ..... 122/4 D X

*Primary Examiner*—Edward G. Favors

*Attorney, Agent, or Firm*—Nixon & Vanderhye

[57] ABSTRACT

A pressurized boiler assembly (e.g. with a circulating fluidized bed combustion chamber), including a pressure vessel pressurized to about 7–30 bar, has a minimum height, minimum number of through extending openings in the pressure vessel, and maximum accessibility to the controls and adjustments for the boiler. A steam drum is mounted by a flange joint above the boiler so that it extends horizontally, with the main body of the steam drum with the pressure vessel, but with a first end of the steam drum exteriorly of the vessel. The control and adjustment elements for the boiler, such as safety valves, pressure indicators, and water gauges, are mounted to the first end of the steam drum, exteriorly of the pressure vessel. A superheater having a discharge conduit is also mounted within the vessel below the steam drum, and the first end of the steam drum and the superheater discharge conduit are essentially the only elements associated with the boiler water and steam system passing through the pressure vessel.

20 Claims, 3 Drawing Sheets

PRESSURIZED BOILER PLANT

BACKGROUND AND SUMMARY OF THE INVENTION

The present invention relates to a pressurized boiler plant comprising a boiler arranged in a pressure vessel and a steam drum connected to the boiler steam/water system.

Boilers generate steam from the heat obtained from combustion processes, hot gases or, chemical reactions occurring inside the boiler. The generated steam is then used elsewhere. In combustion plants, heat required for steam generation is produced by combusting fuel in the combustion chamber of the boiler. Typical fuels are coal, coke, oil, wood, peat or other bio-fuel or, in the pulp industry, black liquor.

In water tube boilers, the actual heating surface, through which heat is transmitted, e.g., from hot flue gases to a vaporizing medium, is formed of tubes which generally constitute a wall(s) and roof surfaces of the boiler. Water or a water/steam mixture flows in the boiler tubes. In this boiler section where the actual boiling takes place, heat is transferred by radiation to the water flowing in the boiler tubes. On other heating surfaces arranged in the boiler, heat is transferred by convection as hot gases are in direct contact with the heating surfaces.

Water is heated in water tube boilers to such a temperature that it will vaporize. The higher the steam pressure in the boiler is, the higher the evaporation temperature will be. Water tube boilers are capable of generating high-pressure steam superheated to a high degree. There are several types of water tube boilers.

In so-called natural circulation type boilers, water circulation in boiler or evaporating tubes is based on the difference between the specific weights of water and steam. The steam being generated in the boiler tubes effects a water/steam flow in the boiler. While flowing upwardly in vertical or inclined riser tubes, the steam also carries water. These riser tubes are connected to a steam drum arranged above the boiler. The water and the steam are separated from each other in the steam drum. The steam drum is provided with means for separating the water and the solid particles possibly entrained in it as thoroughly as possible from the steam for preventing them from being entrained with the steam passing to the super-heaters. The steam is discharged from the steam drum as saturated steam; in other words, at a temperature corresponding to the evaporation temperature of water at the same pressure. From the steam drum, the steam is generally further conducted to superheaters, such as superheating surfaces arranged in the upper section of the boiler or in the flue gas discharge duct, for superheating the steam. The maximum steam pressure in the risers is about 180 to 200 bar. At pressures higher than that, water circulation cannot be guaranteed due to too small differences in specific weights of water and steam.

Water is recycled from the steam drum through downcomers to the inlet of the steam generating tubes in the lower section of the boiler, whereby water circulation in the water/steam system is closed. The water removed as steam from the steam drum is compensated for by feed water, which is often water available at the plant, such as condensed water from the condensers. The feed water is introduced into the steam drum.

The feed water has to be very clean. Scale-forming or other substances that may be entrained with steam to the steam turbine and cause damage to it are especially hazardous. For example, silicates dissolve in steam and form layers on the turbine vanes at certain temperatures, thereby lowering the efficiency of the turbine. Salts may also cause foaming of boiler water, whereby dirty scum may be conveyed from the steam drum into the superheaters. Oxygen contained in the feed water is also harmful because it advances corrosion. Drawbacks caused by impurities of the feed water may be reduced to some extent by adding chemicals to the feed water. The oxygen content of the feed water is maintained at a low level by leading the water through a degasser. If the feed water used is not condensed water and therefore has not been earlier purified, it has to be purified by distillation or by ionic exchange. This additional, clean, water is also introduced into the steam drum.

Salts and other impurities do gather, however, in the boiler water system over time. Therefore, dirty boiler water has to be purified every now and then. Dirty, i.e, concentrated, water remains on the bottom of the steam drum, as the salts mainly accumulate in the water rather than in the steam. Dirty water is removed from the steam drum by blowing it off through a purge valve installed in the bottom of the steam drum. In most cases, there are two purge valves, one for instantaneous blow-off and another comprising an actual control valve for continuous blow-off. The higher the pressure in the boiler is, the more water has to be blown off of the steam drum because the salt dissolving capacity of the steam increases when the pressure becomes higher. Careful control of the boiler water quality is of primary importance to the durability of the boiler tubes.

Due to a high steam pressure, the boiler has to be provided with such equipment and systems as to ensure its operation and control. Due to the high pressure in the boiler, part of the safety equipment is even required by law.

It is necessary that the boiler water/steam system always contain sufficient water. Each boiler has to be provided with at least two reliable means for detecting the water level. In at least one of these means, the water level in the boiler has to be seen directly. That is, one of the water level indicators has to be a water gauge, which is in direct communication with the water and steam volume of the boiler. Water level control is usually arranged to be possible both locally from beside the boiler and from the control room. Usually, one end of the steam drum is equipped with a water gauge, which indicates the water level locally. The water gauge is typically a glass tube. The ends of the glass tube are connected by rubber seals to casings, one of which is in communication with the boiler water volume and the other with the steam volume. The water gauge may be disconnected from the boiler with two valves. The water gauge is also provided with a third valve for purging, which has to be effected at times to be sure that the passages are not clogged. Today, water gauges are often of substantial length, and they are therefore difficult to read from conventional service platforms. In those cases, the water level indicator is especially arranged at a lower level than the steam drum. Data is also transmitted from the other water level indicator of the steam drum to a control room by a remote control system.

In order to restrict excessive pressure increase, the boiler is provided with a safety valve, through which pressure may be relieved until a safe pressure has been reached. The blow-off capacity of the safety valve has to be high enough to prevent the boiler pressure from increasing more than allowed within a certain time when the main shut-off valve is closed at full heating capacity. According to boiler code, safety valves have to be manually relievable. The safety valves may be provided, for example, with a lever attached to a wire cable, which can be pulled from the service platform. One safety valve is normally installed in the steam drum.

Furthermore, the boiler has to be provided with a distinct, clearly visible and reliable pressure gauge. Together with the water level indicators and safety valves, the pressure gauge comprises the safety equipment of the boiler. Also, it is an important gauge in the operation control. Pressure is controlled in the steam tube subsequent to the boiler as well as in the steam drum. The boiler pressure gauges are normally tubular spring gauges, in which pressure is forced into a bent tube in the gauge. The higher the pressure at the control point, the more the tube tends to straighten out. The movement of the free end of the tube is transmitted to the indicator. The boiler has to be also provided with a fixed diameter flange for a check pressure gauge. The check pressure gauge is attached to this fixed diameter flange, in connection with the main pressure gauge when check measurements are performed.

Various meters and adjusting devices are also used for controlling, e.g., boiler flows and temperatures and for producing an image of the boiler operating values.

The boiler plant staff has to continuously control the condition of all meters and valves. Seals and gaskets must be checked so that possible leaks do not remain unnoticed. During each shutdown, every piece of the most important equipment is to be checked to avoid any later interruptions in the operation. Both careful supervision and effective maintenance are very important and necessary aspects with regard to the operability of the plant.

As can be seen from the above description, the steam drum is in communication with the downcomers, risers and steam exhaust tubes of the boiler and, with a great number of highly important meters, valves and feeding means, such as—a feed water inlet and its control valve;—blow-off valves;—steam drum deaeration equipment;—water gauge and water level indicators;—pressure gauges; and—the steam drum safety valve. Most of these require control and maintenance.

In addition to conventional boiler plants, combined power plants having pressurized combustion chambers have become more common. The latter enable higher efficiency in electricity generation. By definition, pressurized fluidized bed combustion differs from fluidized bed combustion in atmospheric pressure primarily in having a higher pressure. The air compressed through a compressor is led through an air distribution grid into a fluidized bed reactor where combustion takes place. The process efficiency increases when a gas turbine, through which the flue gases are conducted, is connected after the fluidized bed reactor. The gas turbine rotates the air compressor. The pressurized fluidized bed reactor is also cooled by steam circulation. After the gas turbine is disposed a boiler for recovering the heat from the flue gases.

Correspondingly, it is possible to gasify solid fuel under pressure in a combined gasification plant and lead the pressurized product gas into the gas turbine combustor. Also in this case, the steam circulation may be connected to the gasifier and to the boiler subsequent to the gas turbine.

The main component of a pressurized boiler plant is a boiler, which is arranged inside a pressure vessel. Thus, for example, in a pressurized circulating fluidized bed reactor process called a PCFB process, the main components, which are the circulating fluidized bed reactor, and generally also a particle separator, e.g., a cyclone or a hot gas filter, are arranged in a pressure vessel. A compressor rotated by a gas turbine produces the pressurized air required for combustion and fluidization. The operating pressure may be, e.g., 10 to 30 bar, typically 10 to 12 bar. First, pressurized air is introduced into the pressure vessel to the space between the reactor and the pressure vessel, whereby the air keeps the walls of the pressure vessel at a relatively low temperature. Thereafter, the air is conducted through a grid into the actual fluidized bed reactor where combustion takes place. Most of the solids entrained with the gases out of the reactor are separated in a cyclone or a filter and recycled to the reactor.

Pressurized fluidized bed combustion has all the advantages of atmospheric pressure processes, but it provides some additional advantages as well. Conventional circulating fluidized bed combustion provides stable and easily controllable combustion. Due to a high flow rate and vigorous mixing, material and heat transmission is effective, resulting in a high combustion efficiency. Sulphur and nitrogen emissions are low because of limestone addition, phased combustion and low combustion temperature. Circulating fluidized bed combustion is suitable for a diversity of fuels, including fuels of poor quality. The temperature is even throughout the reactor and the heat transmission coefficient is high.

Pressurized circulating fluidized bed combustion capital cost results savings. Pressurizing of the combustion chamber provides a high efficiency/volume ratio, so that the plant may be much smaller in size in comparison with present plants. Further, it is also possible to increase the amount of prefabrication and decrease that of installation on site, and thus decrease the total construction time correspondingly.

The operating costs of a pressurized circulating fluidized bed combustion plant are low. Connecting a gas turbine to a conventional steam circulation increases the electricity generation efficiency, which enables generation of more electricity with less fuel.

Arranging a boiler, a circulating fluidized bed reactor or some other reactor in a pressure vessel is in itself relatively simple. The pressure vessel wall must, however, be provided with through-extending openings for fuel feed, steam outlet, ash removal and various other accessories. As described above, the steam drum is provided with a great number of various meters, valves and feed pipes as well as blowdown lines. Therefore, it does not seem reasonable to arrange it in a pressure vessel. On the other hand, several water or steam tubes, i.e., risers or downcomers are arranged between the boiler and the steam drum, and each of them requires an outlet of its own through the pressure vessel wall. The through-extended openings in the pressure vessel walls cause problems. Suitable locations have to be found for them and they have to be sealed. Each separate through-extended opening naturally decreases the durability of the pressure vessel, which has to be reinforced at the points of the through-extended openings.

On the other hand, if the steam drum is arranged inside the pressure vessel, the meters and controls of the steam drum have to be connected to the displays and controls outside the pressure vessel.

In some cases, the size of the pressure vessel also sets a limit to the size of the steam drum to be arranged therein. For a pressurized circulating fluidized bed reactor, the manufacturing costs of the pressure vessel form an important part of the costs of the whole plant. The bigger the plant is the higher the relative costs of the pressure vessel are. Therefore, it is not reasonable to essentially increase the size of the pressure vessel only to enable a bigger steam drum to be arranged therein.

In installations where a steam drum is mounted completely outside the pressure vessel, the height of the vessel can become undesirably large, since the steam drum has a significant vertical dimension. Also, such an installation has relatively high construction costs due to both the high height and the number of through-extending openings required extending between the pressure vessel and the steam drum.

According to the present invention, the drawbacks associated with prior art constructions, as discussed above, are overcome. The pressurized boiler according to the invention has a minimum height, minimum number of through-extending openings in the pressure vessel, and maximum ease of control of and adjustments to the boiler water and steam system. While the invention is primarily described with respect to fluidized bed combustion chambers, it is to be understood that it is adaptable for use with other combustion chambers as well.

According to the present invention, a pressurized boiler assembly is provided, comprising the following elements: A pressurized vessel. A combustion chamber disposed within the pressurized vessel. A boiler disposed in the pressurized vessel, and having a water and steam system, and associated with the combustion chamber. The water and steam system including a steam drum having first and second ends. And, means for mounting the steam drum in the pressurized vessel so that the majority of the steam drum is within the vessel, and the first end is exterior of the vessel.

The water and steam system preferably comprises riser and downcomer pipes, which are connected to the steam drum within the vessel. Control means and adjusting means for the water and steam system, such as water gauges, pressure indicators, safety valves, and the like, are mounted on or adjacent the first end of the steam drum, and exteriorly of the pressurized vessel. The means for mounting the steam drum in the pressurized vessel comprises a flange joint, which mounts it substantially horizontally. The boiler may comprise a natural circulation type boiler.

It is the primary object of the present invention to provide an advantageous pressurized boiler assembly. This and other objects will become clear from an inspection of the detailed description of the drawings, and from the appended claims.

DETAILED DESCRIPTION OF THE DRAWINGS

Figure 1:
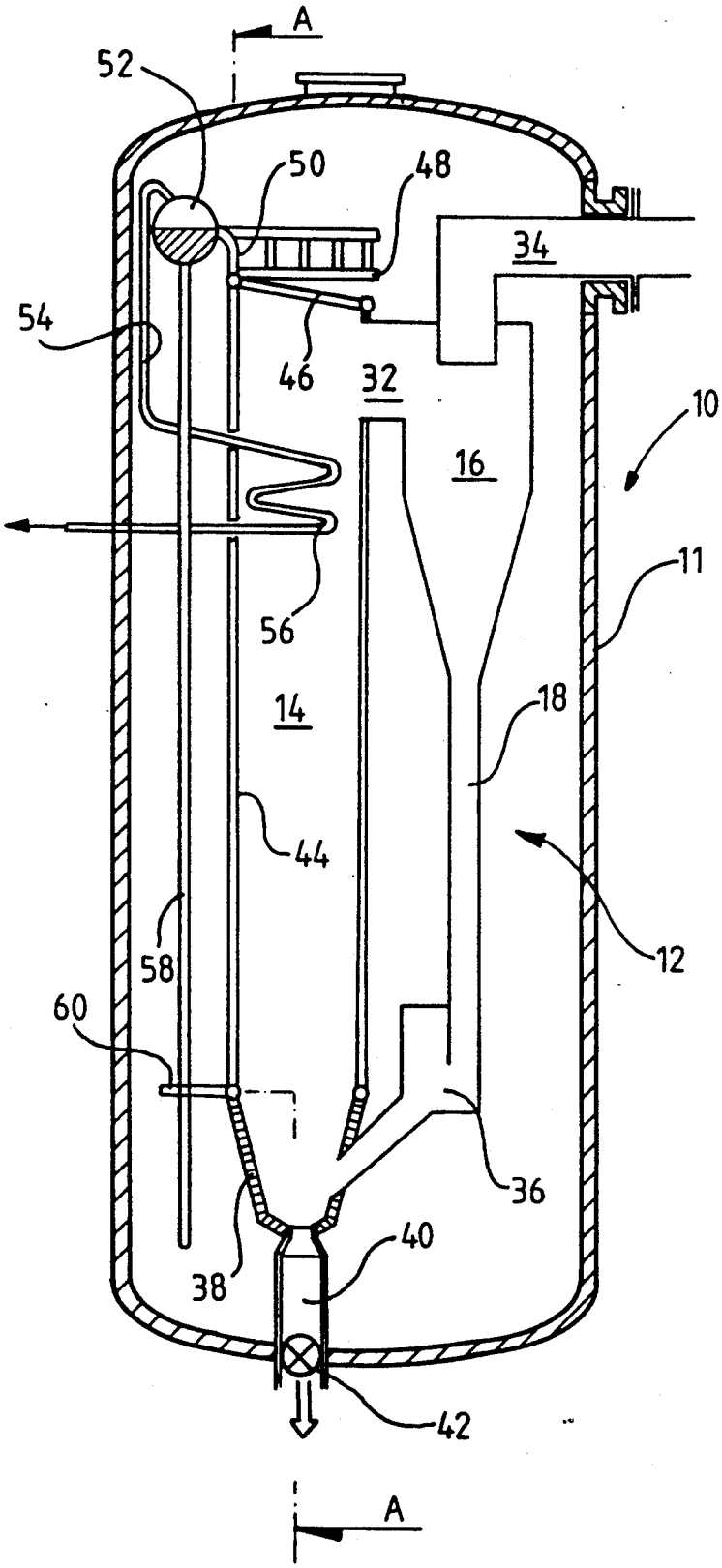
FIG. 1 is a schematic illustration of a pressurized boiler plant according to the invention.
Figure 2:
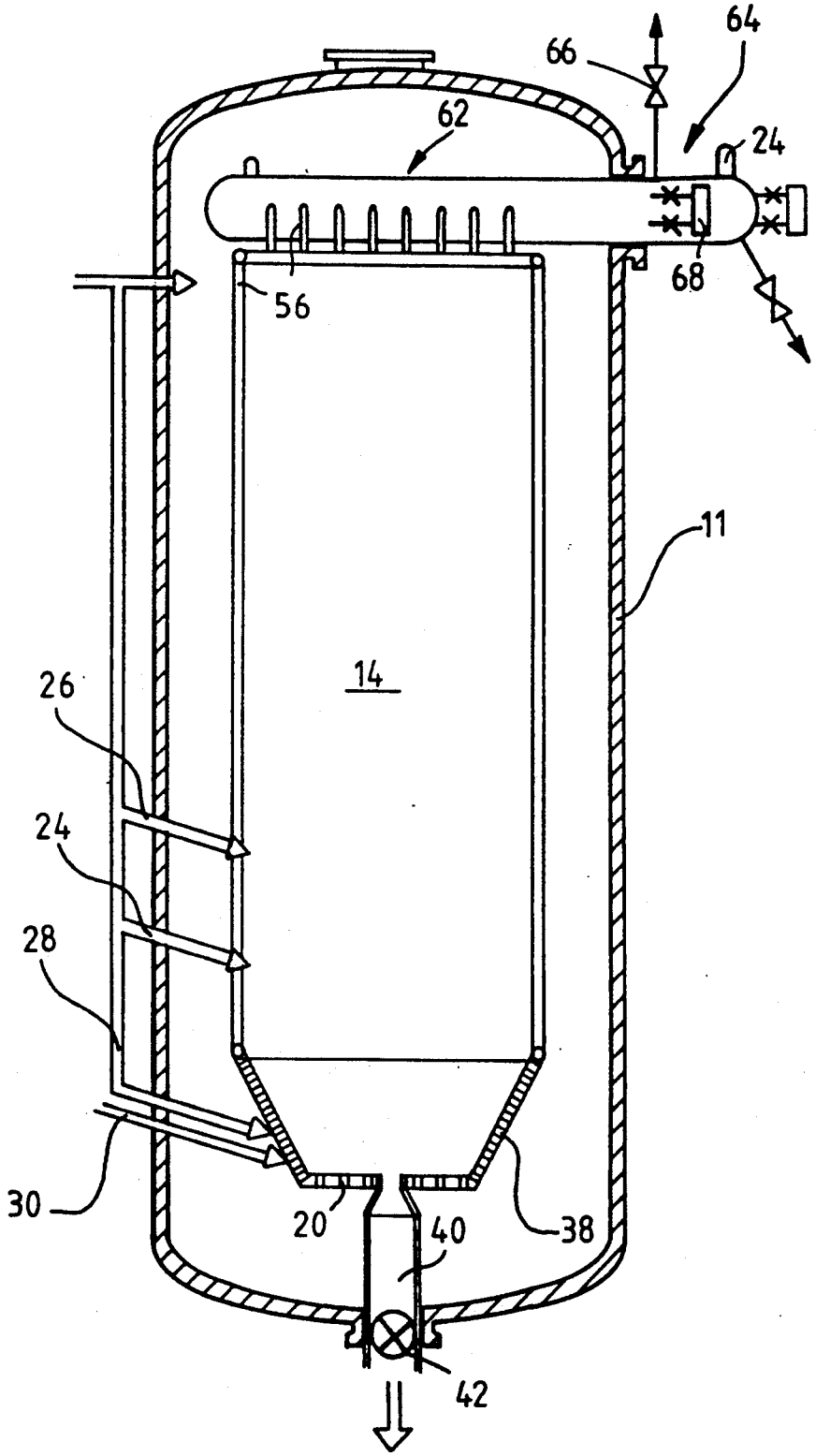
FIG. 2 is a sectional view of the boiler plant of FIG. 1, taken along line A—A thereof.

FIGS. 1 and 2 illustrate a preferred embodiment of the boiler plant of the invention, where a natural circulation type boiler operating on a principle of a circulating fluidized bed reactor 10 is arranged in a pressure vessel 11. The pressure prevailing in the pressure vessel 11 is preferably 7 to 30 bar. The circulating fluidized bed reactor 10 serving as a boiler is composed of a reactor chamber or a combustion chamber 14, a particle separator 16 connected to the upper section of chamber 14, and a return duct 18.

The bottom of the fluidized bed reactor is provided with a grid 20, through which pressurized combustion and fluidizing air is introduced into the combustion chamber 14. Pressurized air is introduced into the combustion chamber 14 also as secondary and tertiary air through conduits 24 and 26. Air is further introduced through conduit 28 into a fuel feed conduit 30.

The particle separator 16 is preferably a cyclone, the upper section of which is in communication with the upper section of the combustion chamber 14 through conduit 32. The upper section of the cyclone is in communication with a conduit 34 for discharging flue gases from the circulating fluidized bed reactor 10. The solids separated from the flue gases in cyclone 16 are returned via duct 18 and gas seal 36 to the lower section of the fluidized bed reactor.

The lower section of the combustion chamber 14 is provided with refractory lining 38, and ash removal means 40, which goes through the grid 20, leading ashes out of the pressure vessel 11. The ash removal means 40 is equipped with a pressure reduction valve 42 for lowering the pressure of the material to be discharged.

The walls 44 and the roof 46 of the upper section of the combustion chamber 14 are vertical water tube walls. The water tube walls 44 may be membrane walls, in which vertical water tubes are welded together by using fins. In this instance, the tubes of the water tube walls 44 serve as boiler risers, where water evaporates thereby generating steam. The upper section of the boiler 10 is provided with collectors 48 for collecting the steam/water mixture formed. From the collectors 48, the water/steam mixture is conducted via steam tubes 50 into a horizontal, elongated steam drum 52 arranged on top of the boiler 10. Steam is led from the upper section of the steam drum 52 via pipe 54 into a superheater 56, where the temperature and pressure of the steam are raised. The pressure in the steam drum 52 is preferably about 100 to 200 bar. Water is led from the lower section of steam drum 52 via downcomers 58 to the collectors 60 of the lower section of the boiler, from which the water is recirculated to the boiler tubes 44.

Figure 3:
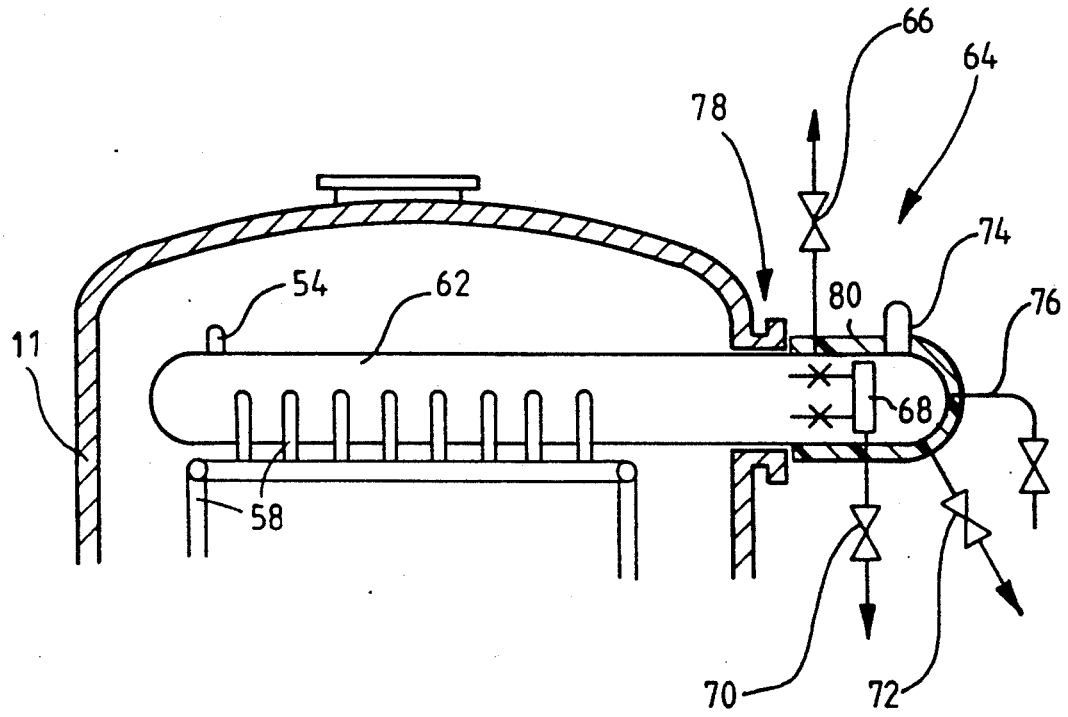
FIG. 3 is an enlargement of the steam drum in the boiler plant of FIG. 1.

FIG. 3 illustrates more in detail the disposition of the steam drum 52 in the pressure vessel 11. The main part 62 of the steam drum 52 is arranged inside the pressure vessel 11. The part 62 is in communication with the steam tubes 50 from the collectors 60 and the downcomers 58 are connected to part 62. The steam tube 54 leading to the superheater 56 is also connected to the part 62 of the steam drum 52.

The part 64 of the steam drum disposed outside the pressure vessel 11 is connected to a safety valve 66, water gauge 68 with a discharge valve 70, blowdown line 72, pressure gauge 74, and feed water tube 76. The steam drum 52 is connected to the wall of the pressure vessel 11 with a flange joint 78.

In the boiler assembly 10 according to the invention, the pressure vessel 11 only requires one connection to the steam drum 52. The downcomers 58 and risers 44 need not penetrate the wall of the pressure vessel 11, which would be necessary if the steam drum were totally outside the pressure vessel 11. Correspondingly, the accessories of the steam drum 52 need not be connected through the pressure vessel 11 wall, which would be necessary if the steam drum 52 were totally inside the pressure vessel 11. All important valves and meters (e.g., 60, 70, 72, 74) of the steam drum 52 may be installed outside the pressure vessel 11. The part 64 of steam drum 52 arranged outside the pressure vessel 11 may be insulated (as illustrated at 80) to avoid heat loss.

The major advantage of the present invention resides, however, in that the pressure vessel need not be as large as it would have to be if the steam drum 52 were arranged therein. Also, when compared with those plants where the steam drum is arranged above the pressure vessel thereby requiring a taller plant construction, the plant arrangement according to the invention is more advantageous.

It will thus be seen that according to the present invention an advantageous pressurized boiler assembly has been provided. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent structures and devices.

What is claimed is:

1. A pressurized boiler assembly comprising:

a pressurized vessel;

a combustion chamber disposed within said pressurized vessel;

a boiler disposed in said pressurized vessel, and having a water and steam system, and associated with said combustion chamber;

said water and steam system including a steam drum having first and second ends; and means for mounting said steam drum in said pressurized vessel so that the majority of said steam drum is within said vessel, and said first end is exterior of said vessel.

2. A boiler assembly as recited in claim 1 wherein said water and steam system comprises riser and downcomer pipes, and wherein said riser and downcomer pipes are connected to said steam drum within said vessel.

3. A boiler assembly as recited in claim 1 further comprising control means and adjusting means for said water and steam system, said control and adjusting means mounted on or adjacent said first end of said steam drum, and exteriorly of said pressurized vessel.

4. A boiler assembly as recited in claim 1 wherein said means for mounting said steam drum in said pressurized vessel comprises a flange joint.

5. A boiler assembly as recited in claim 1 wherein said means for mounting said steam drum mounts it so that it is substantially horizontal in and extending from said pressurized vessel.

6. A boiler assembly as recited in claim 1 wherein said boiler comprises a natural circulation type boiler.

7. A boiler assembly as recited in claim 6 wherein said means for mounting said steam drum mounts it on top of said boiler.

8. A boiler assembly as recited in claim 7 wherein said means for mounting said steam drum mounts it so that it is substantially horizontal in and extending from said pressurized vessel.

9. A boiler assembly as recited in claim 1 further comprising means for pressurizing said vessel so that the operating pressure therein is maintained at between about 7–30 bar.

10. A boiler assembly as recited in claim 1 further comprising means for pressurizing said steam drum so that the operating pressure therein is maintained at between about 100–200 bar.

11. A boiler assembly as recited in claim 1 wherein said combustion chamber comprises a fluidized bed combustion chamber.

12. A boiler assembly as recited in claim 11 wherein said fluidized bed comprises a circulating fluidized bed.

13. A boiler assembly as recited in claim 12 wherein said pressurized vessel has mounted therein a particle separator for separating circulating particles from flue gases, and a duct for returning separated particles to the fluidized bed.

14. A boiler assembly as recited in claim 2 further comprising control means and adjusting means for said water and steam system, said control and adjusting means mounted on or adjacent said first end of said steam drum, and exteriorly of said pressurized vessel.

15. A boiler assembly as recited in claim 3 wherein said control means and adjusting means include a safety valve, a water gauge with a discharge valve, a blowdown line, a pressure indicator, and a feed water tube.

16. A boiler assembly as recited in claim 14 wherein said means for mounting said steam drum mounts it so that it is substantially horizontal in and extending from said pressurized vessel.

17. A boiler assembly as recited in claim 1 wherein said water and steam system further comprises a superheater, having a discharge conduit, mounted within said pressurized vessel and operatively connected to said steam drum; and wherein essentially the only elements associated with said water and steam system that extend through said pressurized vessel comprise said first end of said steam drum, and said discharge conduit from said superheater.

18. A boiler assembly as recited in claim 3 wherein the only portion of said steam drum extending exteriorly of said pressurized vessel comprises said first end.

19. A boiler assembly as recited in claim 1 wherein any portion of said steam drum extending exteriorly of said pressurized vessel is covered with thermal insulation.

20. A circulating fluidized bed pressure boiler assembly, comprising a generally upright pressure vessel capable of maintaining a pressure of about 7–30 bar;

a boiler, including a water and steam system, disposed within said pressure vessel, said water and steam system including risers and downcomers, and a superheater;

a steam drum having a main body, and first and second ends, said risers and downcomers and superheater connected to said main body;

a flange joint for mounting said steam drum with respect to said pressure vessel so that said steam drum extends substantially horizontally, with said main body and second end disposed within said pressure vessel, and said first end exterior of said pressure vessel; and a safety valve, water gauge, and a pressure gauge mounted to said steam drum first end, exterior of said pressure vessel.

* * * * *